US005575332A

United States Patent [19]

Wasterval, Jr.

[11] Patent Number: 5,575,332

[45] Date of Patent: Nov. 19, 1996

[54] REELED WELL TUBING SYSTEMS

[75] Inventor: Philip W. Wasterval, Jr., Houston, Tex.

[73] Assignee: Sundowner Offshore Services, Inc., Houston, Tex.

[21] Appl. No.: 511,611

[22] Filed: Aug. 5, 1995

[51] Int. Cl.[6] ..... E21B 19/22

[52] U.S. Cl. ..... 166/77.1; 166/85.1

[58] Field of Search ..... 166/75.11, 77.1, 166/77.2, 77.3, 77.4, 85.1

[56] References Cited

U.S. PATENT DOCUMENTS

| | | | |
|---|---|---|---|
| 3,116,781 | 1/1964 | Rugeley et al. | 166/77.2 X |
| 3,690,136 | 9/1972 | Slator et al. | 166/77.2 X |
| 4,585,061 | 4/1986 | Lyons, Jr. et al. | 166/77.3 |
| 4,673,035 | 6/1987 | Gipson | 166/77.2 |
| 4,743,175 | 5/1988 | Gilmore | 166/77.2 X |
| 5,029,642 | 7/1991 | Crawford | 166/77.2 X |
| 5,133,405 | 7/1992 | Elliston | 166/77.3 X |
| 5,505,259 | 4/1996 | Wittrisch et al. | 166/77.1 X |

OTHER PUBLICATIONS

Reeled Tubing, Incorporated brochure, undated but prior to Dec. 1994.

Hillman Rollers brochure excerpts, Aug. 1990.

*Primary Examiner*—Frank Tsay

*Attorney, Agent, or Firm*—Pravel, Hewitt, Kimball & Krieger

[57] ABSTRACT

A well tubing injection system includes a manipulator located between a reel on which reeled well tubing, typically used in well maintenance and workover operations, is stored. The tubing is of the type passed into and out of a well through a drill floor at a well site by a tubing injector. The system moves the tubing reel with respect to the tubing injector as pipe moves into or out of the well. The system significantly reduces the number of bending events imposed on the tubing during trips into and out of the well.

16 Claims, 5 Drawing Sheets

REELED WELL TUBING SYSTEMS

BACKGROUND OF INVENTION

1. Field of Invention

The present invention relates to reeled well tubing systems used in well operations.

2. Description of Prior Art

It has been an increasingly accepted practice for a variety of reasons to store and transport well tubing, particularly for petroleum exploration and production operations, on large reels. The reeled tubing was transferred from the reel by a tubing injector into and out of the well through the well drill floor. The well tubing was subject to a number of bending events as the tubing was straightened and unbent from the reel for injection into the well, or then again bent several times as it was extracted from the well for storage on the reel.

The service life of reeled tubing was typically determined by the number of bending events to which the tubing was subjected. To the extent that the type and degree of bending to which the tubing was subjected could be reduced, the service life of the tubing would have been extendable. However, so far as is known, the diameter of the storage reel and the length and nature of tubing travel between the reel and the injector have heretofore been the primary factors in determining the type and extent of bending events on reeled well tubing.

Another consideration in the use of reeled tubing has been the amount of space required. Typically, the tubing storage reel has been kept a considerable distance from the injector. This has been done to control an angle, known as the "fleet angle," between the plane of longitudinal axis of the tubing leaving the reel and the plane of the rotational axis of the reel. If the fleet angle was not properly regulated, the tubing did not wrap and unwrap properly on the storage reel.

SUMMARY OF INVENTION

Briefly, the present invention provides a new and improved well tubing injection system for guiding reeled well tubing as it moves between a storage reel and a tubing injector at a well site. The well tubing injection system includes a reel of coiled well tubing and a manipulator. The well tubing injection system also includes a tubing injector at the well site to and from which the manipulator transfers the tubing for feeding and extraction with respect to the well.

A manipulator according to the present invention includes a guide mechanism for receiving the tubing from the storage reel and guiding the tubing towards the tubing injector. The manipulator also includes structure for moving the storage reel with respect to the guide mechanism as the tubing enters and leaves the storage reel. Further, according to the present invention, the tubing storage reel and guide mechanism are located on a frame at an elevated position with respect to the floor at the well site, such as a deck of a drilling platform. With the present invention, the number of bending events imposed by the system on the tubing during travel between the storage reel and tubing injector are materially reduced. This significantly extends the useful service life of the reeled well tubing.

DESCRIPTION OF PREFERRED EMBODIMENT

Figure 1:
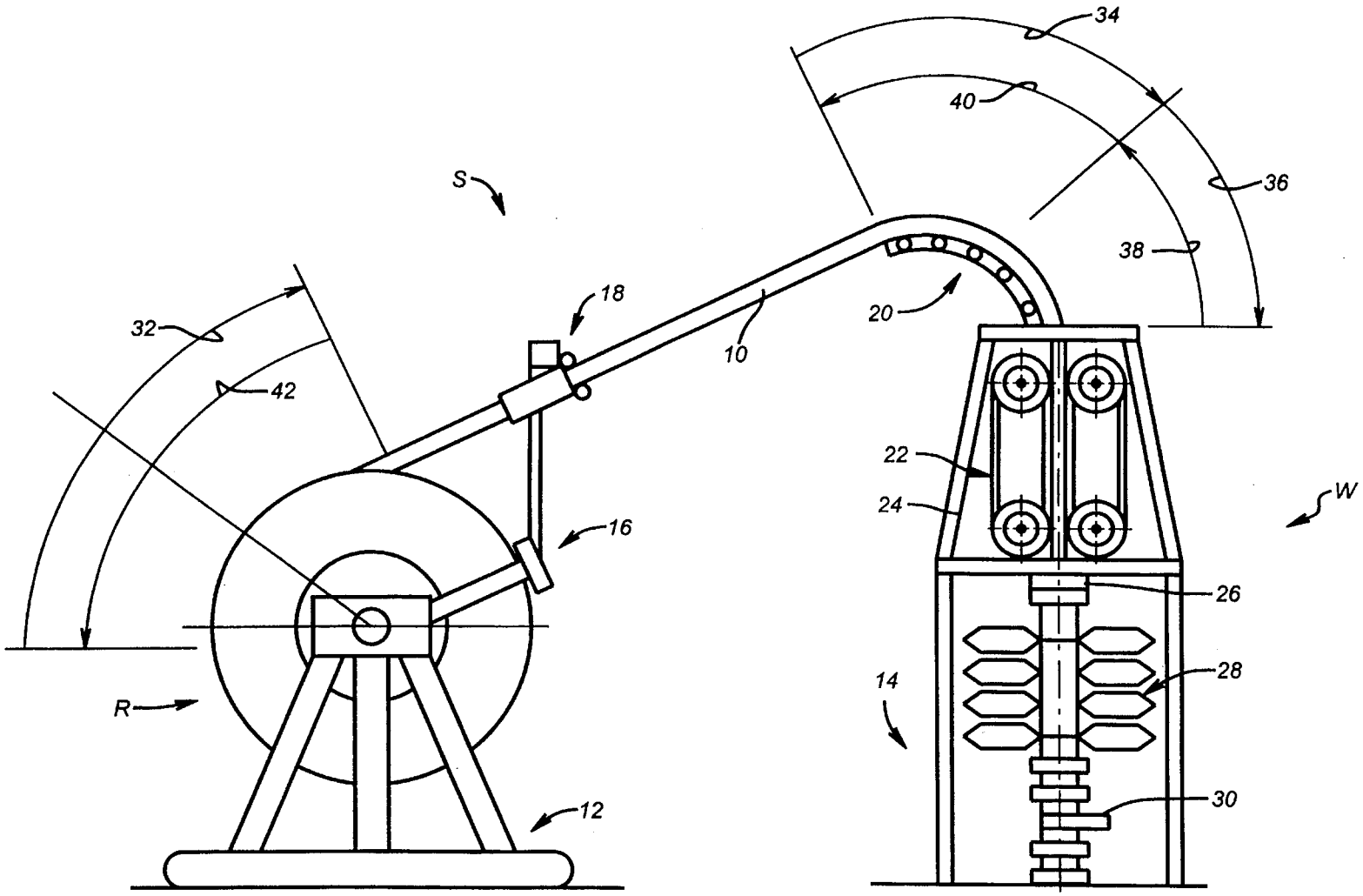
PRIOR ART FIG. 1
FIG. 1 is an elevation view of a prior art reeled well tubing system.

In the drawings, a prior art reeled well tubing system S for a petroleum or other well W is shown in schematic form in FIG. 1. The well W may be one at an offshore drilling platform or one at a land well rig, as desired. The well tubing system S includes a reel or spool of well tubing 10 stored in a number of successive spirally wound layers on a reel R. The reel R is mounted on a skid 12 adjacent a well head 14 of the well W. The reel R is rotatably driven by a suitable power source and gearing to selectively rotate its drum containing the tubing 10 in either a forward or reverse direction. Thus, the reel R may both unreel the tubing 10 or wind the tubing 10 back onto its drum. A level-wind mechanism 16 is provided with the reel R to guide the tubing 10 both off of and back onto the reel R. As is conventional, the tubing 10 passes upwardly from the reel R through a counter or measuring mechanism 18 and over tubing guides 20 to a tubing injector 22.

It has been the practice in a prior art tubing system S to locate the reel R some considerable distance from the injector 22. The principal reason for this was to insure proper and orderly wrapping and unwrapping of the tubing 10 on the reel R. An angle known in the art as a "fleet angle" was defined by the angle between the longitudinal axis of the tubing 10 as it left the reel R and the rotational axis of the reel R. By providing a considerable distance between reel R and injector 22, the fleet angle was kept within limits and proper wrapping and unwrapping of the tubing 10 was achieved. This, however, was done that the expense of using considerable space at the well site. For offshore drilling platforms, surface area or platform space has generally been quite limited and thus an important consideration.

The tubing injector 22 is mounted on an injector support frame 24 with a well stripper 26, as is also conventional, on the well head 14. The well head 14 also includes a conventional blowout preventer stack 28 mounted above a flow tee 30. The tubing injector 22, as is conventional, injects tubing 10 from the reel R downwardly through the well head 14 into the well W. The tubing injector 22 also periodically extracts the tubing 10 for reeling and storage back onto the reel R, depending upon well requirements.

The tubing 10 undergoes a number of cycles of trips into and out of the well W through the injector 22. With a prior art reeled well tubing system S, as any portion of the tubing 10 was introduced into and moved out of the well W, it went through a complete cycle or round-trip from the reel R into the well W, out of the well and back onto the reel R. During such a cycle or round-trip, the tubing 10 was subjected to at least six bending events in a vertical plane perpendicular to the axis of reel R. Specifically, as shown in the drawings, a first bending event exemplified by an arrow 32 occurred as the tubing 10 was uncoiled from the reel R and straightened for passage through the counter mechanism 16. The tubing 10 then was subject to second and third bending events, indicated by arrows 34 and 36, into a vertically extending form for passage downwardly vertically into the tubing injector 22 for entry into the well.

After service in the well, when the tubing 10 was being withdrawn from the well, a reverse sequence of bending events occurred. The reverse sequence of bending events included fourth and fifth bending events, indicated by arrows 38 and 40, during movement back and upwardly from the tubing injector 22 into a shape in which it could pass through the counter 16. Additionally, a sixth bending event indicated by an arrow 42 occurred as the tubing 10 was coiled back onto the reel R. Finally, the tubing 10 was also subject to lateral or horizontal bending events. Sections of tubing 10 laterally distributed across the width of reel R travelled from the reel R to the tubing guide 20 and injector 22 at the well head 14.

The well tubing 10 was thus subject to a considerable number of bending events as it was straightened and unbent from the reel R for injection into the well W, and again as it was re-bent on extraction from the well W for storage on the reel. The service life of the reeled tubing 10 was thus for the most part determined by the number of bending events to which the it was subjected during its service life.

Figure 2:
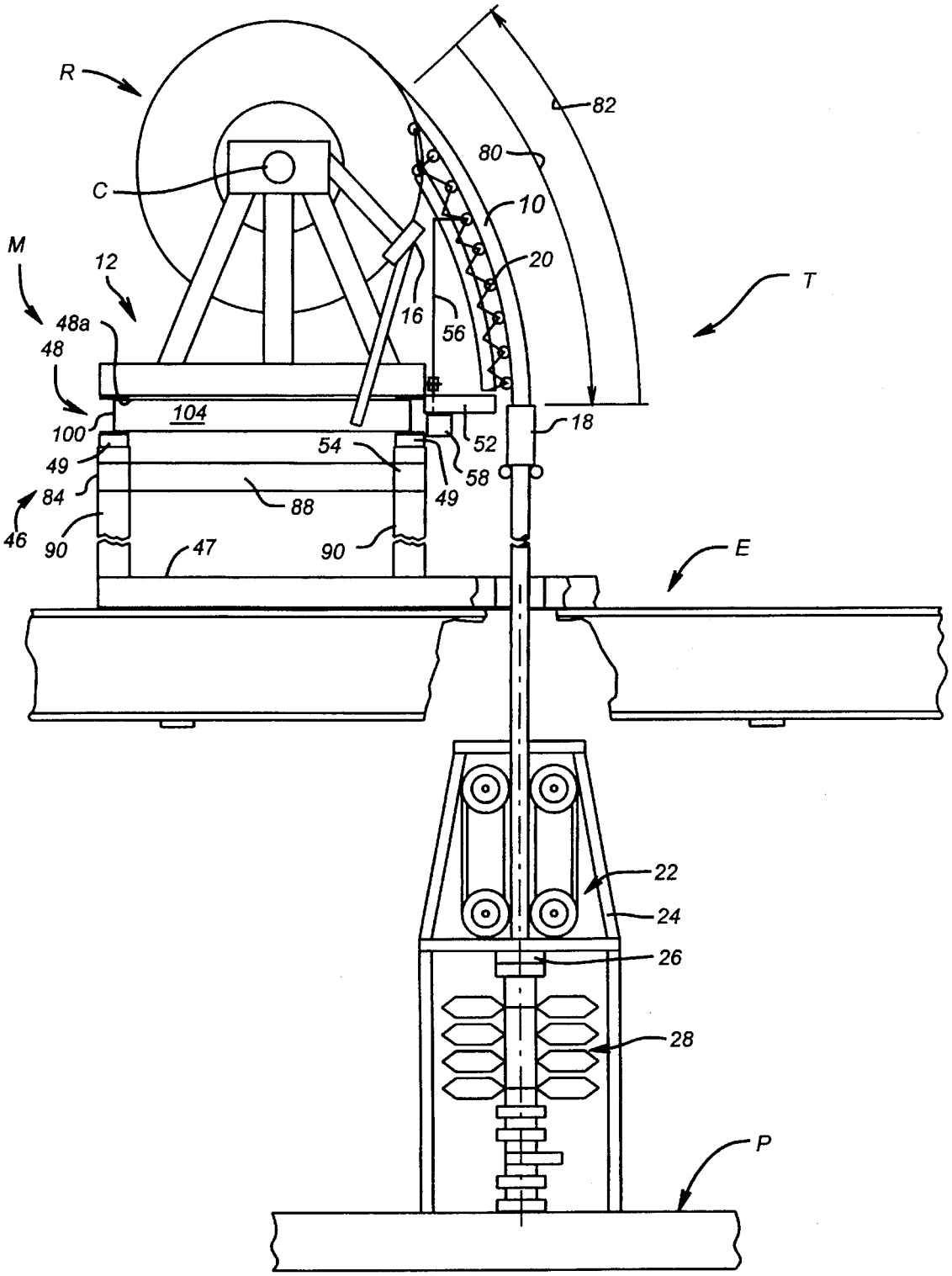
FIG. 2 is an elevation view of a reeled well tubing system according to the present invention.

According to the present invention, a reeled well tubing system T including a manipulator M (FIG. 2) is provided for the tubing injector 22. Portions of the tubing system T which are of like structure and function to that in the prior art system S bear like reference numerals for ease of reference and understanding. The manipulator M of the tubing system T includes a table or support frame 46 and a laterally movable sledge or sled 48 on which the tubing reel R is mounted. As will be set forth below, the sledge 48 is adapted for reversible bi-directional lateral travel of the storage reel R with respect to the tubing injector 22 as the tubing 10 enters and leaves the storage reel R.

The sledge 48 is adapted to receive the reel R on an upper surface 48*a*. The reel R is rotatably movable about its central axis or axle C on the sledge 48 to allow the tubing 10 to be taken on and off of the reel drum for passage into the tubing injector 22. Rollers 49 or other mechanisms for permitting relative lateral travel of the sledge 48 over the sledge 46 are provided at each of the corners of the frame of the sledge 48. A suitable type of rollers 49 are those heavy duty rollers sold in the industry as Hilman Rollers for transport of heavy loads.

The support frame 46 may take several forms, depending on the arrangement of equipment at the site of the well head 14. For example, the support frame 46 may be mounted on a skid or pallet 47 situated on an elevated deck E (FIG. 2) above a platform or floor P of an offshore drilling/production rig or vessel. Alternatively, the support frame 46 may be an integral part of a separate framework F (FIGS. 5–8).

In either form, the tubing injector 22 is mounted on support frame 24 at the wellhead 14. The wellhead 14 includes the well stripper 26, blowout preventer stack 28, and flow tee 30. With the present invention, the tubing guide 20 is mounted and supported with the reel R and moves with it as the sled 48 moves with respect to the table 46.

Figure 3:
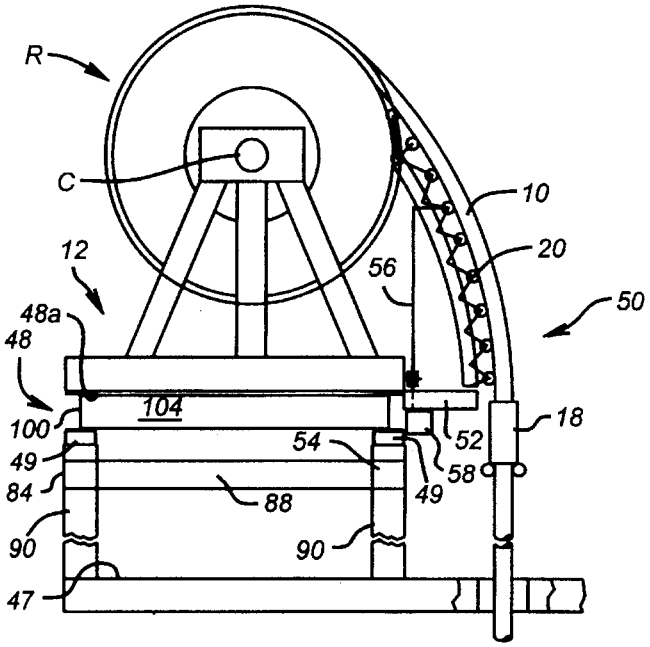
FIG. 3. is an elevation view of the manipulator for reeled well tubing system of FIG. 2.
Figure 4:
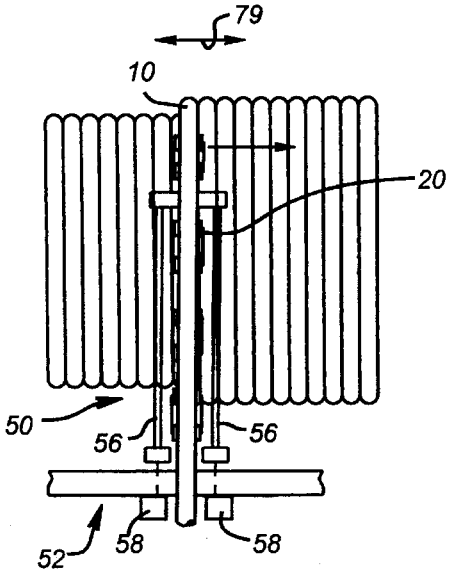
FIG. 4 is an elevation view of a portion of the structure of FIG. 3.
Figure 5:
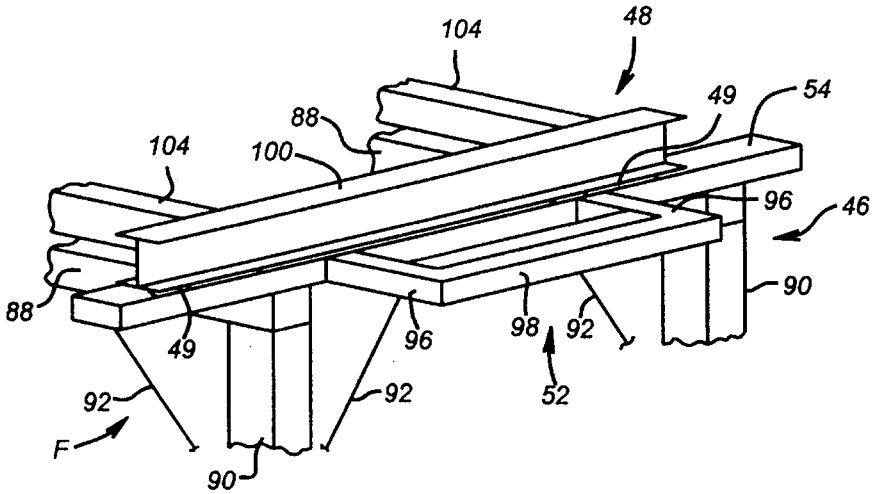
FIG. 5 is an isometric view of a manipulator support frame for the structure of FIG. 3.

A centering mechanism 50 (FIGS. 3&4) is provided for the tubing guide 20 according to the present invention. The centering mechanism 50 is mounted with a support frame extension 52 extending outwardly from a beam 54 of the table 46. The centering mechanism 50 has a pair of upwardly extending contact arms 56 which are pivotally mounted with the support frame 52 on each side of the tubing guide 20. Each of the upwardly extending arms 56 is adapted to be contacted by the tubing guide 20 as the reel R moves laterally on the sledge 48 with respect to the table 46.

The centering mechanism 50 also regulates and controls the fleet angle, defined as the angle between a rotational axis 51 of the reel R and a longitudinal axis 53 of the tubing 10 leaving the reel R, within acceptable limits. This insures proper wrapping and unwrapping of the tubing on the reel R without requiring excessive spacing required by the prior art systems.

Also, when the tubing 10 at the end of one particular layer on the reel R is reached, and a newer, lower layer begins to be unwound, arms 56 of the sensing mechanism 50 cause reversal of direction of travel of the sledge over the table 46. When one of the upwardly extending arms 56 is contacted by the tubing guide 20, a movement sensing mechanism 58 of centering mechanism 50 senses such contact. The movement sensing mechanism 58 may be a hydraulic, mechanical or electrical switch, a valve, or other suitable mechanical gear. The switch or valve 58 of the particular arm 56 contacted causes the application of motive power through a set of supply conduits 60 to a motor 62 of a movement mechanism 64. When contact between the arm 56 and the tubing guide 20 ceases, the sensing mechanism 58 associated with that particular arm 56 interrupts the flow of power to the motor 62.

Relative lateral movement of the sledge 48 with respect to the table 46 is imparted by the motor 62 of movement mechanism 64. The motor 62 may be mounted with the table 46 in the framework F by support legs 66, or otherwise suitably supported. The motor 62 is preferably a hydraulic motor, although other suitable power sources could be used for this purpose, driving a sprocket gear 68.

The motor 62 receives operating power through power supply conduits 60 and causes the sprocket 68 to drive a gear chain or belt 70 to cause an axle or shaft 72 to rotate in, either a clockwise or counter-clockwise direction, depending upon the desired movement of the sledge 48 with respect to the table 46. The direction of movement is controlled according to which of the contact arms 56 is in contact with the tubing guide 20. The axle or shaft 72 driven by the motor 62 causes movement of cables 74 which are mounted on pulleys or reels 76. The drive cables 74 are mounted to extend between the sled 48 and the frame 46 and pass over the reels 76. As the axle or gear 72 rotates in response to motor 62, the cables 74 cause the sledge 48 move laterally across the table 46. It should be understood that other arrangements, such as a rack-and-pinion gear system, may be used in place of the drive cables 74. The direction of movement of sledge 48 on the table 46 is controlled by the direction of rotation of axle 72, which is in then controlled by the motor 62.

Power supplied to the motor 62 thus causes the sledge 48 to move laterally with respect to the table 46 until the tubing guide 20 no longer is in contact with the arm 56 sensing such contact. As has been set forth, power to the motor 62 then ceases. In this manner, the position of the tubing guide 20 and consequently the reel R with respect to the tubing injector 22 is maintained in a centered position with respect to the wellhead W. Accordingly, the amount of any bending of tubing 10 in a lateral direction, as indicated by an arrow 79 (FIG. 4), is minimized according to the present invention.

It is also to be noted that with the present invention, the well tubing 10 is stored on the reel R at an elevated position (FIGS. 2 and 6) with respect to the tubing injector 22 by means of the table 46 and sledge 48. Accordingly, as the tubing leaves and enters the reel R during its travel with respect to the tubing injector 22, only two bending events, as indicated by arrows 80 and 82 (FIG. 2), are imposed on the tubing 10. Thus, a significant increase in the service life of the well tubing 10 is afforded with the present invention.

Figure 6:
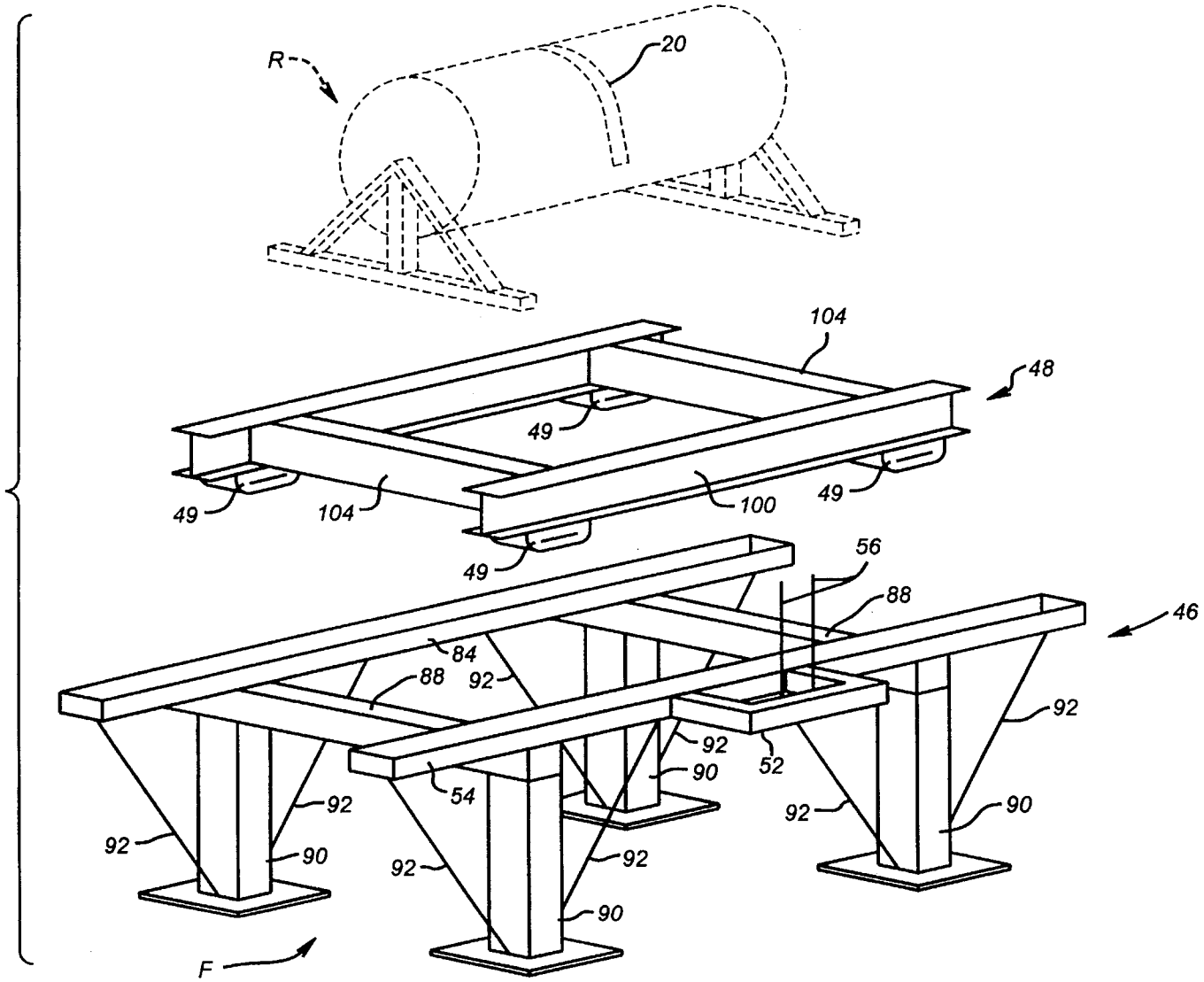
FIG. 6 is a partially exploded isometric view of the structure of FIG. 5.
Figure 7:
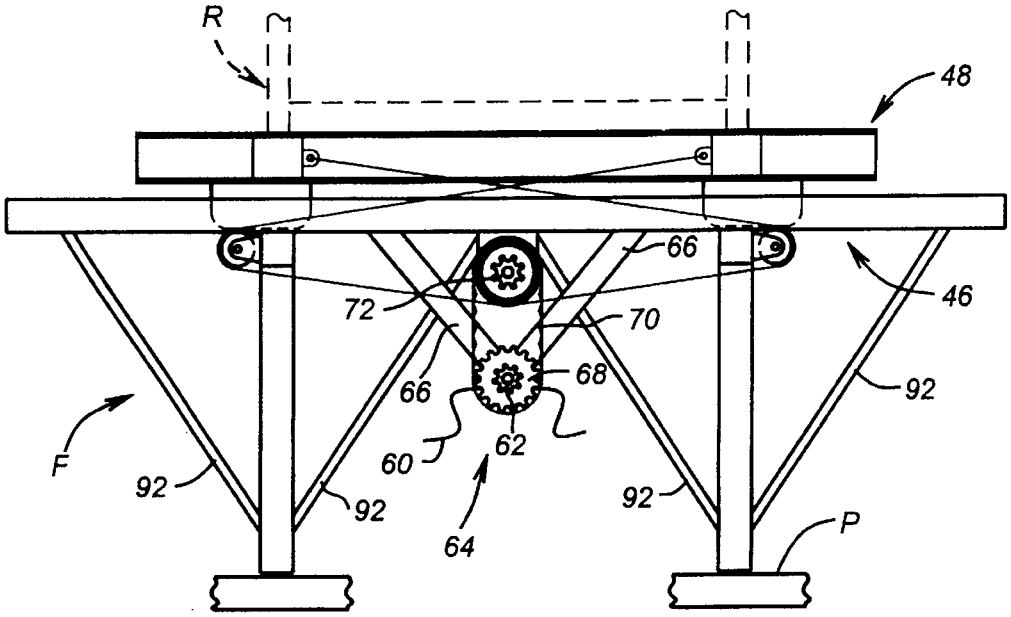
FIG. 7 is an elevation view of the structure of FIG. 5.
Figure 8:
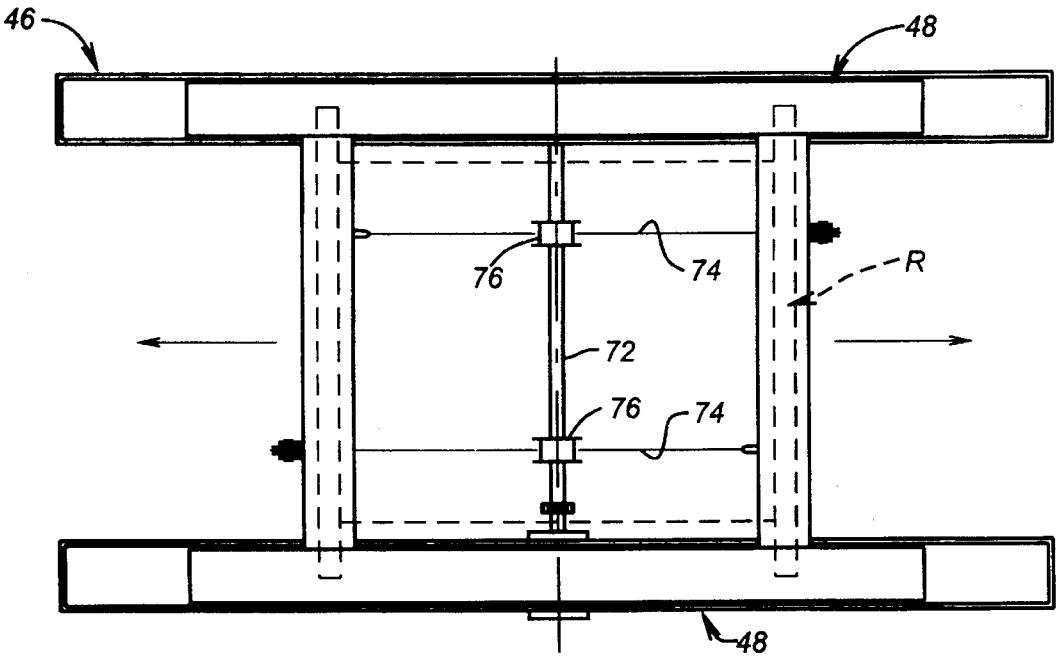
FIG. 8 is a plan view of the structure of FIG. 7.

The table 46 in framework F includes the beam 54 and a parallel, spaced beam or track 84 (FIG. 6). Portions of the system T, such as reel R and guide mechanism 50 are not shown in FIG. 5 or are shown only in phantom in FIGS. 6, 7 and 8 in order that the framework F may be more clearly seen. The parallel beams or tracks 54 and 84 are supported by a pair of cross-beams 88. The cross-beams 88 are mounted in a suitable support arrangement, such as support uprights or legs 90 extending upwardly from the drill floor P past the tubing injector 22. Suitable braces or struts are provided, as indicated schematically at 92, for the beams or tracks 54 and 84 of the table 46.

The support frame or extension 52 provided for the tubing guide 20 extends outwardly from the forward beam or track 54 of the framework F. The support frame 52 defines a path of movement for passage of the tubing 10 through the counter 18 into and out of the well W by the tubing injector 22 for straightening. The support frame 52 may be formed of any suitable structure to define such a path, such as by outwardly extending beams 96 which extend outwardly from the track 54 and a transverse beam or member 98 connecting the beams 96 at their outer ends.

The sledge or sled 48 of the framework F has a generally rectangular frame which is formed from two beams 100 and 102 generally parallel with and mounted above the transverse beams or tracks 50 and 84 of the table 46. Sets of the rollers 49 are mounted at suitable locations beneath each of the beams 100 and 102. The beams 100 and 102 of the sledge 48 are connected by two transverse, spaced connector beams or supports 104.

In the operation of the present invention, as tubing 10 is needed for injection by the injector 22 into the well W at the wellhead 14, the reel R storing the tubing 10 is caused to rotate. The tubing 10 passes through the tubing guide 20 downwardly as it is shown into the injector 22. The tubing guide 20 accordingly is subjected to lateral moving forces as the tubing 10 is unwound from the reel R. As the tubing 10 is being unreeled from the reel R, the centering mechanism 50 senses any lateral movement forces on the tubing guide 20.

As the tubing 10 passes from the reel R and tends to cause the tubing guide 20 to move and follow the tubing 10, the centering mechanism 50 through its sensor arms 52 activates the movement mechanism 64. This in turn causes the sledge 48 to move laterally with respect to the table 46. The tubing guide 20 remains centered with respect to and above the tubing injector 22. The tubing 10 exiting the reel R thus passes vertically downwardly from the reel R into the tubing guide 20. In this manner, the portion of the reel R from which the tubing 10 is presently being unwound remains aligned with the tubing injector 22. Such alignment is maintained both while tubing 10 is being unreeled as well as while it is being coiled back onto the reel R.

The movement mechanism 64 thus causes the sledge 48 to move laterally with respect to the table 46 as the tubing 10 is moving either into or out of the injector 22 from reel R. In this manner, the position of the tubing guide 20 and consequently the reel R with respect to the tubing injector 22 is maintained in a centered position with respect to the wellhead W. Accordingly, the amount of any bending of tubing 10 in a lateral direction, as indicated by an arrow 79, is minimized according to the present invention.

Since the well tubing 10 is at an elevated position on the reel R only two bending events are imposed on the tubing 10 during movement to and from the tubing injector 22. This decrease in bending events provides a significant increase in the service life of the well tubing 10 according to the present invention.

It is also to be noted that the present invention affords a saving in the amount of space required at the well site. By moving the reel R under control of the centering mechanism 50, the fleet angle is maintained within acceptable limits. This allows the reel R to be positioned at a considerably closer distance to the injector 22 than was the case with prior art systems.

Having described the invention above, various modifications of the techniques, procedures, material and equipment will be apparent to those in the art. It is intended that all such variations within the scope and spirit of the appended claims be embraced thereby.

I claim:

1. A manipulator for guiding reeled well tubing as it moves between a storage reel and a tubing injector at a well site, comprising;

a sled having the storage reel mounted therewith;

a frame receiving said sled thereon;

roller means permitting movement between said sled and said frame;

a guide mechanism mounted with said frame for receiving the tubing from the storage reel and guiding it towards the tubing injector; and means for moving the storage reel with respect to said guide mechanism as the tubing enters and leaves the storage reel.

2. The manipulator of claim 1, wherein the well site is a drilling platform.

3. The manipulator of claim 2 wherein the tubing injector is located on a platform deck of the drilling platform.

4. The manipulator of claim 1, wherein:

said means for moving comprises motor means for moving said sled with respect to said frame.

5. The manipulator of claim 1, wherein the tubing is uncoiled from the storage reel as it moves from the reel to the guide mechanism, and further including:

means for sensing lateral movement of the tubing as it uncoils from the storage reel; and means for activating said means for moving to align the tubing leaving the storage reel with said guide mechanism.

6. The manipulator of claim 1, wherein the tubing is coiled onto the storage reel as it enters the storage reel from the guide mechanism, and further including:

means for sensing lateral movement of the tubing as it is coiled on and off the storage reel; and means for activating said means for moving to align the tubing entering the storage reel with said guide mechanism.

7. The manipulator of claim 1, wherein the tubing is coiled in successive layers wrapped on the storage reel for movement on and off the storage reel during reversible bi-directional lateral travel of the storage reel with respect to the guide mechanism, and further including:

means for reversing the direction of said means for moving as the storage reel reaches the end of one direction of its lateral travel.

8. A reeled well tubing injection system for moving well tubing to and from a storage reel and a tubing injector on a platform deck of a drilling platform, comprising:

a sled having the storage reel mounted therewith; and a frame mounting the storage reel at an elevated position with respect to said platform deck;

roller means permitting movement between said sled and said frame; and a guide mechanism fixedly mounted on said frame for receiving the tubing from the storage reel and guiding it towards the tubing injector.

9. The tubing injection system of claim 8, further including:

means for moving the storage reel with respect to said guide mechanism as the tubing enters and leaves the storage reel.

10. The tubing injection system of claim 9, wherein said means for moving comprises motor means for moving said sled with respect to said frame.

11. The tubing injection system of claim 8, wherein the tubing is uncoiled from the storage reel as it moves from the reel to the guide mechanism, and further including:

means for sensing lateral movement of the tubing as it uncoils from the storage reel; and means for activating said means for moving to align the tubing leaving the storage reel with said guide mechanism.

12. The tubing injection system of claim 8, wherein the tubing is coiled onto the storage reel as it enters the storage reel from the guide mechanism, and further including:

means for sensing lateral movement of the tubing as it is coiled onto from the storage reel; and means for activating said means for moving to align the tubing entering the storage reel with said guide mechanism.

13. The tubing injection system of claim 8, wherein the tubing is coiled in successive layers wrapped on the storage reel for movement on and off the storage reel during reversible bi-directional lateral travel of the storage reel with respect to the guide mechanism and further including:

means for reversing the direction of said means for moving as the storage reel reaches the end of one direction of its lateral travel.

14. A well tubing injection system, comprising:

a storage reel containing well tubing coiled on it for use in a well;

means for sensing lateral movement of the tubing as it is coiled and uncoiled on and off the storage reel;

a tubing injector for moving the tubing into and out of the well;

a guide mechanism for receiving said tubing from said storage reel and guiding said tubing towards said tubing injector;

means for moving said storage reel with respect to said guide mechanism as said tubing enters and leaves said storage reel; and means for activating said means for moving to align the tubing entering the storage reel with said guide mechanism.

15. A well tubing injection system for moving tubing into and out of a well, comprising:

a storage reel containing well tubing for use in the well;

a sled having said storage reel mounted therewith;

a frame mounting said storage reel at an elevated position with respect to the well;

means for moving said sled with respect to said frame as said tubing enters and leaves said storage reel;

a tubing injector for moving said tubing into and out of the well; and a guide mechanism mounted on said frame for receiving said tubing from said storage reel and guiding said tubing towards said tubing injector.

16. A well tubing injection system, comprising:

a storage reel containing well tubing coiled in successive layers for movement on and off said storage reel during reversible bi-directional lateral travel thereof for use in a well;

a tubing injector for moving the tubing into and out of the well;

a guide mechanism for receiving said tubing from said storage reel and guiding said tubing towards said tubing injector;

means for moving said storage reel with respect to said guide mechanism as said tubing enters and leaves said storage reel; and means for reversing the direction of said means for moving as the storage reel reaches the end of one direction of its lateral travel.

* * * * *